United States Patent [19]

Scuto

[11] Patent Number: 4,742,776

[45] Date of Patent: May 10, 1988

[54] CARTRIDGE PROJECTILE FOR SMOOTHBORE FIREARMS

[75] Inventor: Antonio Scuto, Milan, Italy

[73] Assignee: Cervo S.p.A., Italy

[21] Appl. No.: 38,746

[22] Filed: Apr. 15, 1987

[51] Int. Cl.[4] ..... F42B 11/10

[52] U.S. Cl. ..... 102/509; 102/439; 102/501; 244/3.23

[58] Field of Search ..... 102/439, 448, 501, 507–510, 102/517; 244/3.23

[56] References Cited

U.S. PATENT DOCUMENTS 3,138,102 6/1964 Meyer et al. ..... 102/509
4,413,564 11/1983 Brown ..... 102/501

*Primary Examiner*—Harold J. Tudor
*Attorney, Agent, or Firm*—Darby & Darby

[57] ABSTRACT

The invention relates to the art field of cartridges for conventional smoothbore shotguns used in hunting. A projectile is disclosed that consists in a hollow cylindrical leaden body the forward end of which is stopped by a dome reflexed back into the hollow body and exhibiting an external recess.

8 Claims, 2 Drawing Sheets

CARTRIDGE PROJECTILE FOR SMOOTHBORE FIREARMS

BACKGROUND OF THE INVENTION

The invention relates to a projectile for the cartridges fired from smoothbore shotguns. Persons skilled in the art will know that certain animals, wild boar for example, are hunted using conventional shotguns with a smooth bored, tapered barrel, firing cartridges charged with a single slug rather than with fine shot or pellets.

The firing of single projectile cartridges from conventional smoothbore firearms is beset by considerable problems, the most evident of which being a noticeable inaccuracy of the trajectory described by the projectile itself; such directional inaccuracy is accentuated by the taper of the barrel in firearms of the type.

Clearly enough, a fundamental characteristic required of the projectile of a shotgun cartridge is that it should describe an accurate trajectory.

Another characteristic required of cartridge projectiles as mentioned above is that they should flatten readily once having penetrated into the body of an animal, so that the force of the charge can be spent entirely within the body.

Various projectiles have been designed to meet such a requirement, though in practice, none of these designs have been found to offer both of the aforementioned characteristics at one and the same time.

Certain of the projectiles in question afford good directional accuracy, but penetrate excessively into the body of the animal as a result of their ogival shape, and of their center of gravity, which lies forward of the center of thrust. Projectiles of this type do not flatten readily, and can pass clean through the animal quite easily.

Other types of projectile are designed to flatten readily on impact, and incorporate wedges or other elements to that end; these are particularly expensive to manufacture however, and noticeably lacking in directional accuracy.

Accordingly, the object of the invention is to embody a projectile that possesses both of the characteristics aforementioned—i.e. a projectile that will describe an accurate trajectory in flight, and flatten readily once having penetrated the body of the animal.

A further object of the invention is that of gaining a reduction in the manufacturing costs of such a projectile, the structural features of which are such that it can be cast or forged.

SUMMARY OF THE INVENTION

The stated objects and other objects besides are realized with a cartridge projectile for smooth bore firearms according to the invention.

The projectile disclosed takes the form of a hollow cylindrical body, fashioned from metal and embodied with an open rear end, the forward end of which is stopped by a dome that is reflexed into the hollow body and exhibits an external recess.

BRIEF DESCRIPTION OF THE DRAWINGS

The invention will now be described in detail by way of example, with the aid of the accompanying drawings, in which.

DESCRIPTION OF THE PREFERRED EMBODIMENT

Figure 2:
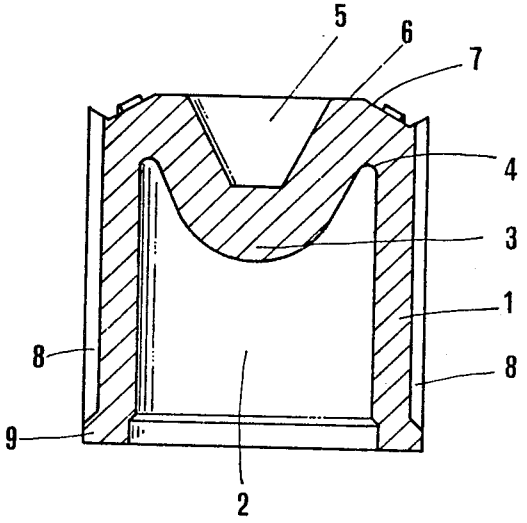
FIG. 2 shows the projectile in longitudinal section.
Figure 1:
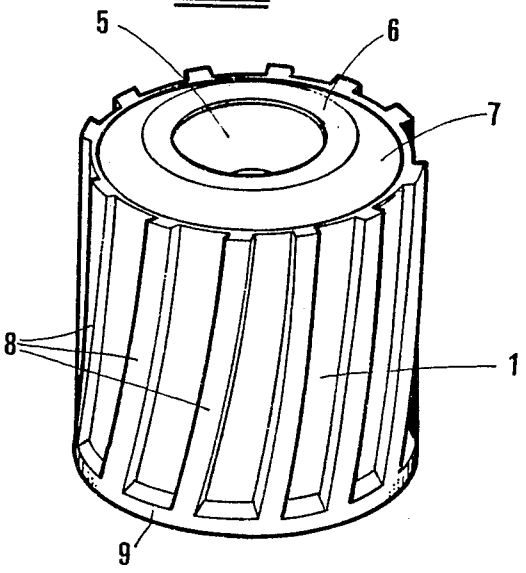
FIG. 1 is a perspective of the projectile disclosed.

As the drawings illustrate, the projectile consists substantially in a cylindrical body 1; this will be fashioned from lead or one of its alloys.

Viewed from the rear in the direction through which it penetrates the animal, the body 1 exhibits a cylindrical and concentrically disposed cavity 2 that is stopped at the forward end by a dome 2 the convex face of which is reflexed inward, extending into the cavity 2. The dome 3 is of substantially hemispherical shape and merges with the inside wall of the cylindrical body 1 at the point denoted 4.

5 denotes a recess of substantially frustoconical shape let into the nose of the projectile and accommodated by the reflexed dome 3; the nose presents a flat frontal surface 6 that interconnects with the outer cylindrical surface of the body 1 by way of a sloping annular surface 7.

The outer cylindrical surface of a projectile according to the invention exhibits a plurality of ribs 8, substantially helical in embodiment, the rear ends of which merge with a ring 9. The depth of the ring is identical to that of the ribs, and the overall diameter of the cylindrical body 1 is less than the bore of the firearm barrel, measured at the breech. The ribs 8 serve to guide the projectile through the initial stretch of the barrel, and must be able to spread, deforming without difficulty as the bore of the barrel gradually tapers toward the muzzle.

The features and advantages of a projectile thus embodied will now be described.

The dome 3 serves to displace the center of gravity of the projectile forward from its center of thrust, and ensures a high degree of directional accuracy.

Being rendered hollow by the cavity 2, the cylindrical body 1 exhibits a long and slender side wall which merges with the dome 3 at a point 4 that deforms readily on impact, thereby permitting the cylindrical wall to flatten and spread outwards on penetrating the flesh of the animal. The projectile is also made capable of considerable deformation by virtue of the shape of the nose, which spreads flat and drags the cylindrical wall with it in so doing. In practice, one will often gain a total separation of the nose from the cylindrical body at the join 4, the effect of which is to produce two projectiles of dissimilar diameter, and therefore with dissimilar penetration characteristics. Similarly, the creation of a recess 5 in the nose favors its deformation and ultimate separation from the cylindrical body 1.

Embodied with the flat frontal surface 6, the nose ensures excellent directional accuracy of the projectile whilst preventing it from passing clean through the animal.

The projectile disclosed is of singularly simple shape, with no re-entrants, and thus lends itself readily either to casting or to hot or cold forging processes, using lead or a lead alloy.

Figure 3:
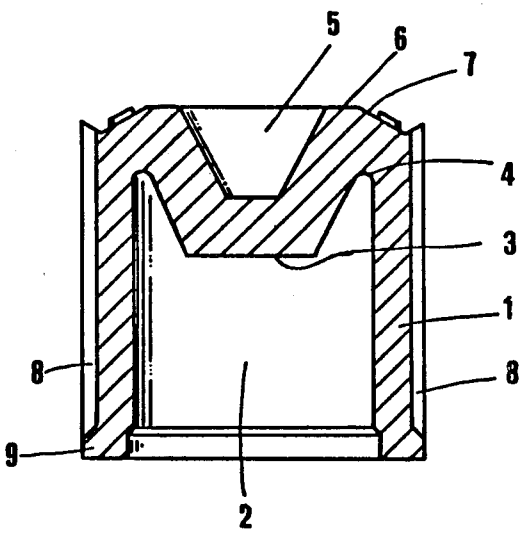
FIG. 3 is a longitudinal section showing the projectile with a frusto-conical dome.

FIG. 3 shows the dome 3 as frusto-conical in shape. Needless to say, the geometry of the dome 3 could be other than as illustrated, and the recess 5 might be of different shape and depth, without prejudice to the substance of the appended claims.

What is claimed:

1. A cartridge projectile for smoothbore firearms comprising:

a hollow cylindrical metal body;

a front end of the body being closed by a concave dome reflexed partially into the hollow body and provided with an external recess whereby the projectile flattens after impact with a target; and said body having a plurality of externally disposed ribs extending obliquely from said body, said ribs having helical shape and extending from the front end to a rear end of the body.

2. The cartridge projectile of claim 1, wherein the body presents along an axial section, a substantially uniform thickness.

3. The cartridge projectile of claim 1, wherein the dome presents a hemispherical configuration on the side projecting into the hollow body.

4. The cartridge projectile of claim 1, wherein the dome presents a frusto-conical configuration on the side projecting into the hollow body.

5. the cartridge projectile of claim 3, wherein the external recess has a frusto-conical shape.

6. The cartridge projectile of claim 4, wherein the external recess has a frusto-conical shape.

7. A cartridge projectile for smothbore firearms comprising:

a hollow cylindrical metal body;

a front end of the body being closed by a dome reflexed partially into the hollow body and provided with an external recess such that the projectile flattens after impact with a target;

said body further including a plurality of externally disposed ribs extending obliquely from said body, said ribs having helical shape and extending from the front end to a rear end of said body; and said body presents along an axial section, a substantially uniform thickness.

8. A cartridge projectile for smoothbore firearms comprising:

a hollow cylindrical metal body;

a front end of the body being closed by a dome reflexed partially into the hollow body and provided with an external recess, such that the projectile flattens after impact with a target; and said dome having a hemispherical configuration on the side projecting into the hollow body.

* * * * *